United States Patent [19]

Diesinger et al.

[11] Patent Number: 4,520,972

[45] Date of Patent: Jun. 4, 1985

[54] SPIN-STABILIZED TRAINING MISSILE

[75] Inventors: Walter Diesinger, Bergisch-Gladbach; Axel Homburg, Taunusstein-Wehen, both of Fed. Rep. of Germany

[73] Assignee: Dynamit Nobel Aktiengesellschaft, Troisdorf, Fed. Rep. of Germany

[21] Appl. No.: 386,072

[22] Filed: Jun. 7, 1982

[30] Foreign Application Priority Data

Jun. 5, 1981 [DE] Fed. Rep. of Germany ..... 3122320

[51] Int. Cl.[3] ..... F42B 13/20

[52] U.S. Cl. ..... 244/3.1; 244/3.24; 102/529

[58] Field of Search ..... 102/444, 498, 529; 244/3.23, 3.24, 3.27, 3.28, 3.29, 3.3, 3.1

[56] References Cited

U.S. PATENT DOCUMENTS

| | | | |
|---|---|---|---|
| 3,292,879 | 12/1966 | Chilowsky | 244/3.3 |
| 3,687,398 | 8/1972 | Beuschel | 102/498 |
| 3,800,706 | 4/1974 | Gawlick et al. | 244/3.23 |
| 3,944,168 | 3/1976 | Bizien et al. | 244/3.28 |
| 4,112,843 | 9/1978 | Laviolette | 244/3.3 |
| 4,128,060 | 12/1978 | Gawlick et al. | 102/529 |
| 4,133,265 | 1/1979 | Diesinger et al. | 102/529 |
| 4,140,061 | 2/1979 | Campoli | 102/521 |
| 4,209,147 | 6/1980 | Jones, Jr. | 244/3.28 |
| 4,297,948 | 11/1981 | Donovan | 102/501 |
| 4,430,943 | 2/1984 | Bock et al. | 102/529 |

FOREIGN PATENT DOCUMENTS

| | | | |
|---|---|---|---|
| 0025373 | 3/1981 | European Pat. Off. | 244/3.29 |
| 2831574 | 2/1979 | Fed. Rep. of Germany | 102/529 |
| 2091856 | 8/1982 | United Kingdom | 102/529 |

*Primary Examiner*—Donald P. Walsh
*Assistant Examiner*—D. K. Cornwell
*Attorney, Agent, or Firm*—Antonelli, Terry & Wands

[57] ABSTRACT

A spin-stabilized training missile is equipped with a stabilizer device for reducing spinning in order to decrease the flight range. The training missile is designed so that its stabilization attainable solely by the spin upon firing is not sufficient for a stable flight in the practice range. The required additional stabilizing in the practice range is obtained by a stabilizer device or control airfoil effecting simultaneously, after leaving the practice range, such a spin reduction that the training missile becomes unstable and the range of flight is controlled.

15 Claims, 17 Drawing Figures

SPIN-STABILIZED TRAINING MISSILE

Figure 1:
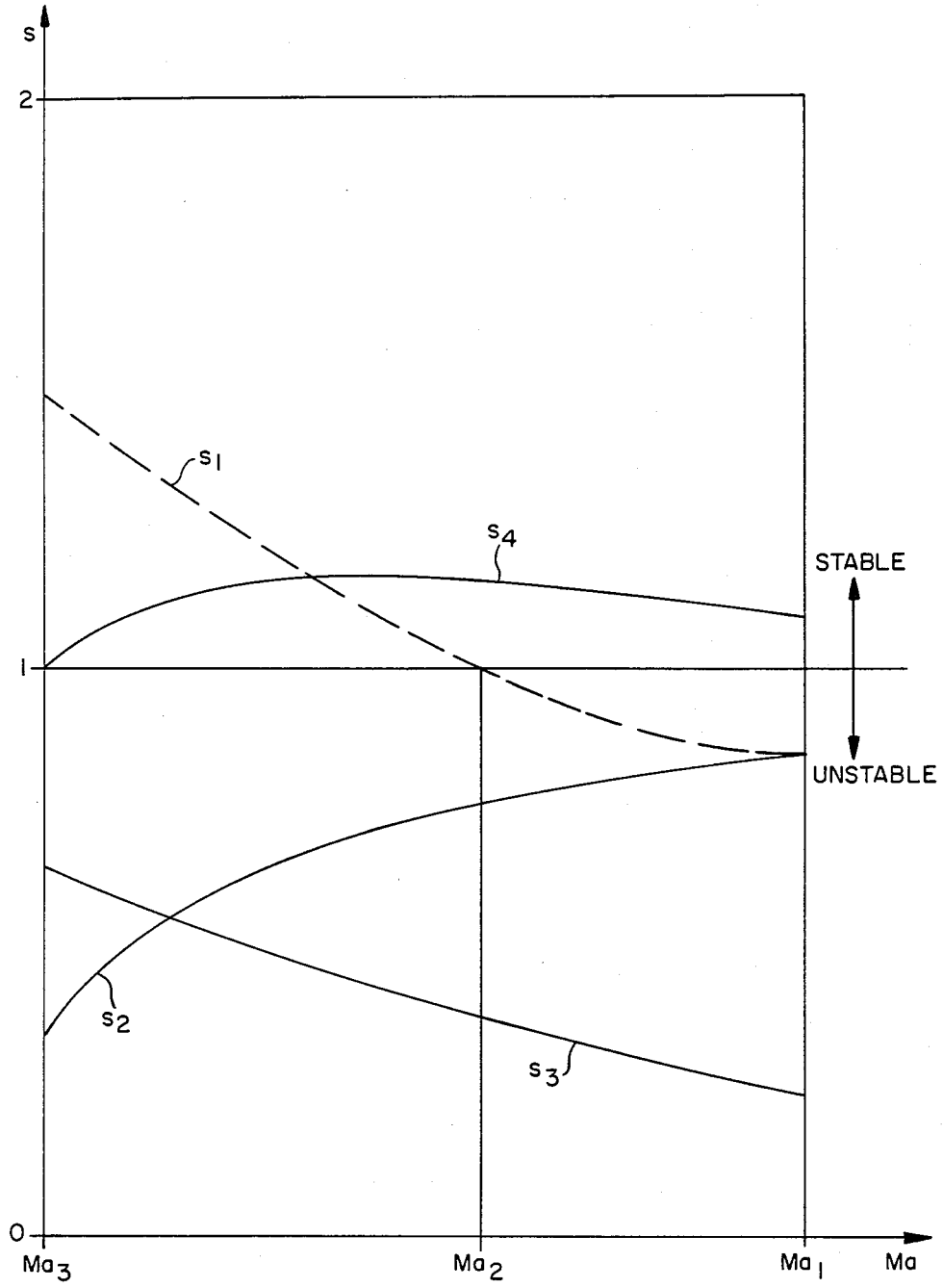

The invention relates to a spin-stabilized training missile having means for reducing the spin in order to decrease the flight of the missile.

German Pat. No. 1,678,197 discloses a spin-stabilized projectile for drill ammunition with a shortened range wherein without disintegration of the projectile a sudden increase in aerodynamic resistance is obtained by providing that the projectile becomes instable by an induced spin reduction and continues its flight with the tail pointing forward and thus with an increased aerodynamic resistance. Spin reduction is obtained by means of radial surfaces in the zone of the ogive or in the manner of a radial compressor, i.e. by the utilization of Coriolis acceleration in the air flowing radially to the outside within the projectile by way of appropriate bores. A broadening of this principle is described in DOS (German Unexamined Laid-Open Application) No. 2,149,977. According to DOS No. 2,616,209, the provision can furthermore be made to block the spin brake, acting as a radial compressor, along the practice flight path by making the dynamic pressure of the air flow effective on a piston which initially forces a viscous fluid out of a chamber until the flow channels for the radial compressor are vacated.

The radial surfaces, not inclined in the axial direction, in the zone of the ogive have the disadvantage that they become effective right from the beginning, i.e. directly upon exit from the firing device. Furthermore, the stability of the training missile in the practice range is unfavorably affected by the action site of the forces in front of the center of gravity of the projectile. Thereby the aerodynamic behavior of the training missile is greatly altered as compared with the original, so that even though the requirement of a shortened range is normally met, there is no satisfactory ballistic coincidence. According to the safety requirements imposed nowadays, it is furthermore desirable to limit the maximum firing distance under all circumstances, i.e. to render the training missiles fail-safe. Also the fulfillment of this requirement is questionable in case of radial surfaces in the ogive zone, for example when foreign bodies in the air tear off all surfaces or if ricocheting occurs.

The same holds true for the compressor solution which, though somewhat more advantageous aerodynamically as compared with the solution with radial surfaces in the ogive zone, is substantially less favorable with respect to the fail-safe requirement, for instance due to blockage of the axial inlet by foreign bodies or jamming of the piston.

The invention is based on the object of constructing a spin-stabilized training projectile, as well as other spin-stabilized training missiles, in such a way that with a maximally simple structure an extensive fulfillment of the fail-safe requirement is ensured. In other words, the training missile is restricted in its maximal firing range under, if at all possible, all circumstances so that it can be deployed on comparatively small practice ranges. In this context, the training missile is to differ as little as possible from the original missile in its external shape, in its mass, in its spin, in its mass moments of inertia, and in the aerodynamic coefficients, so that a good ballistic coincidence is attained in the practice range with the original missile to be used in combat and no extensive modifications are required, for example, with respect to the propellant charge or the jacket of a training projectile. The structure should be maximally simple to be able to produce economical training missiles, especially in case of comparatively inexpensive original missiles. The training missiles should permit usage of a sabot (adapter) and should also be usable without such sabot. Additionally, the original firing device should be usable without modifications.

The object has been attained according to the invention by a construction including a stabilizer means for providing stabilization of the spin of the missile so that stable flight is maintained only within the desired training range. A rotating missile has a stable flight if the following applies with regard to the stability factor s:

$$s = K\left(\frac{\omega}{v_\infty}\right)^2 > 1$$

wherein

K is a constant specific to the missile, $\omega$ is the angular velocity about the longitudinal axis of the missile, and $v_\infty$ is the velocity of the undisturbed oncoming air flow.

This relationship applies only in an approximation. However, the exact stability law is not to be discussed herein because it has no or insignificant influence on the basis of this invention. Additional data in this regard can be found, for example, in Molitz and Strobel, "Äussere Ballistik" (External Ballistics), Springer Publishers, 1963; and Germershausen et al., "Waffentechnisches Handbuch" (Weapons Manual), Rheinmetall GmbH, Düsseldorf, 1977.

According to the invention, the training missile is designed so that the aforementioned relationship is not met, i.e. $s<1$, and thus the training missile would fly in an unstable fashion without special measures. Due to the increased aerodynamic resistance during unstable flight, the training missile will not exceed the predetermined safety range. In this connection it is possible that the missile is destroyed by the forces and moments, which are considerable, at the beginning or during an unstable flight, or that the missile flies subsequently in a new, stable position with the tail pointing forwardly, likewise with a greatly increased aerodynamic resistance.

However, in order to maintain the training missile in a stable condition, in accordance with its training mission, along the training flight path, i.e. for a short period of time, a stabilizer means or device is arranged according to the invention on the training missile, compensating for the stability deficit of the spin stabilization. In this connection, the stabilizer means is mounted behind the center of gravity of the training missile, preferably in its tail region, to attain the stabilizing effect.

Since in case of a rotating training missile the flight velocity $v_\infty$ normally drops faster that the angular velocity $\omega$, the training missile, in correspondence with the aforementioned equation, becomes ever more stable with a decreasing flight velocity, without special measures, so that the requirement for restricting the flight range cannot be met without additional steps.

In accordance with this invention, the stabilizer means, is therefore, additionally designed so that it generates a longitudinal (pitching) moment which brakes the rotation, so that $(\omega/v_\infty)^2$ becomes smaller after leaving the practice range, but optionally also along the practice flight range. The invention is also applicable to spin-stabilized missiles wherein the flight velocity $v_\infty$ does not drop faster than the angular velocity $\omega$. In this case, the stabilizer means in case of the training missile must reduce the ratio $(\omega/v_\infty)^2$ more greatly than is the case with the original missile. This is necessary since the aerodynamic stabilization effected by the stabilizer means, i.e. the stability factor s (obtained by the stabilizer means), increases with a reduced supersonic flight velocity for aerodynamic reasons which shall be explained in greater detail herein.

Thus, according to the invention, the stability deficit caused by braking the rotation—also called roll damping'becomes large at the earliest at the end of the training flight path so that the stabilizer means is no longer adequate for maintaining the combined spin-stabilizer stabilization. The training missile becomes unstable and does not exceed the required, especially small residual flight path.

The training missile is fail-safe with a failure of the stabilizer, the rotation-damping as well as stabilizing effect thereof is lost, and the training missile will fly in an unstable fashion due to its design. Furthermore, the training missile meets the requirement for a maximally accurate simulation of the original trajectory in the practice range since it is possible, depending on the design of the stabilizer—as will be explained in greater detail below—to initiate the rotation-damping of the training missile only at the end of the training flight path or, in case of lesser demands for trueness to the original, also as early as during the training flight phase.

The spin stability of the training missile as compared with that of the original missile can be reduced with an unchanged angular and flight velocity, to $s<1$, for example by displacing the center of gravity toward the rear. Thereby the distance between the pressure point (site of attack of the resultant R of the aerodynamic forces without considering the stabilizer forces) of the training missile and its center of gravity is increased whereby the constant K specific to the missile is reduced, for reasons which need not be explained in depth herein, and accordingly the stability factor s is likewise decreased. The rearward shifting of the center of gravity, for example by the choice of different materials or by the formation of cavities furthermore has the advantage that the training missile is under less stress during firing than the original missile, since the point of attack of the d'Alembert inertial forces is closer to the tail.

Assuming that during firing, the original missile (i.e. the combat missile) and the training missile have identical angular velocities as well as identical masses, in order to be able to use, besides the identical launching tube, also the same propellant charge, and if furthermore the external contour is extensively retained—except for the stabilizer—then spin stabilization can also be reduced by lowering the moment of inertia $I_l$ about the longitudinal axis of the missile (high mass density in the proximity of the axis of rotation) and increasing the moment of inertia $I_q$ about the transverse axis of the missile (high mass density front and rear). This, in turn, is derived from the constant K specific to the missile, for which the following applies: $K \sim I_l^2/I_q$.

If small differences in contour are permitted or necessary, additional possibilities are provided, in correspondence with $K \sim d/l^2$ for reducing the spin stabilization of the training missile with respect to that of the original missile. Accordingly, a reduction at a constant mass m is also possible by reducing the caliber d and/or increasing the length l of the missile.

The aerodynamic resistance W of a missile changes with an affinitive change in the diameter d of the missile in proportion to $d^2$, whereas increasing the length, for example by increasing the cylindrical portion of the missile, results in an only small increase in aerodynamic resistance W. A small reduction of the caliber d of the training missile therefore offers another possibility for compensating, if necessary, for the increase in aerodynamic resistance $\Delta W$ caused by the stabilizer.

The stabilizer can basically be secured in a fixed manner to the training missile, for example by providing the missile at the tail with several fixed airfoils uniformly distributed over the circumference, these airfoils being inclined under the adjustment angle $\epsilon$ with respect to the longitudinal axis of the missile.

There are cases wherein the fixed installation of a stabilizer is impossible, difficult, or achievable only by expensive modifications, for example at the sabot of a subcaliber projectile. In these cases, it is suggested to store the stabilizer in the training missile and deploy same only during flight in a manner known per se. The mechanism necessary for this purpose is fail-safe because the training missile becomes immediately unstable in case of failure.

This arrangement can be further developed by reducing the roll damping during flight as a result of the centrifugal force which decreases with a dropping angular velocity, if this is advantageous in correspondence with the ballistic requirements posed in an individual case.

Additional, especially advantageous embodiments of the invention are hereinafter described. These include training missiles with a separate stabilizer carrier rotatable in the axial direction with respect to the remainder of the training missile—also called base member—which makes it possible for the missile, depending on its design, to meet various requirements.

Another possibility for compensating, as completely as possible, the influence of the stabilizer during the training flight phase, even with a fixed stabilizer, involves the use of a jet propulsion unit or engine. The jet engine has at least two symmetrically arranged outlet nozzles inclined with respect to the longitudinal axis of the missile so that the training missile is exposed to an accelerating longitudinal torque as well as to a drive thrust within the training flight path. The jet engine is preferably designed as a solid-propellant engine, but it can also be a cold or hot gas propulsion as set forth, for example, in DOS No. 2,557,293.

The accompanying drawings show basic relationships of the invention and several embodiments thereof which are hereinafter described in greater detail.

Figure 6A:
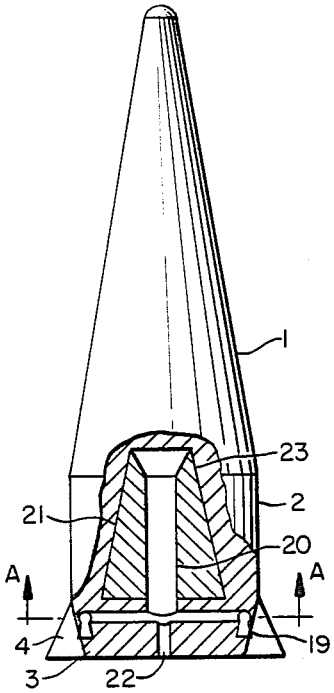
Figure 6B:
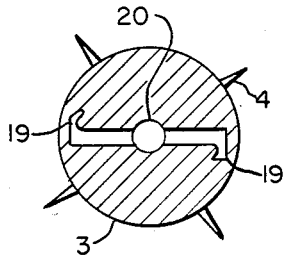

In the drawings:

FIG. 1 shows a qualitative curve of the stability factor s in dependence on the training flight Mach number Ma;

FIGS. *2a* through *2d* show the relationships of the resulting oncoming flow direction $v_{res}$ at various points of the training flight path;

FIGS. *3a* and *3b* show two embodiments of a first version of the training missile;

FIGS. *4a* through *4c* show three embodiments of a second version of the training missile;

FIGS. *5a* through *5e* show four embodiments of a third version of the training missile; and FIGS. 6*a* and 6*b* show a fourth version of the training missile.

In FIG. 1, the qualitative curves of the various stability factors, namely $s_1$=s (spin) without stabilizer influence $s_2$=s (spin) due to stabilizer influence $s_3$=s (stabilizer)

$s_4$=(spin+stabilizer)=$s_2+s_3$ are plotted in dependence on the training flight Mach number Ma.

The training missile leaves the launching tube with the Mach number Ma. If the stabilizer fails, then the training missile is unstable between the Mach numbers $Ma_1$ and $Ma_2$ according to curve $s_1$ and is increasingly braked. In contrast thereto, with a stabilizer acting rotation clamping in accordance with this invention, the stability factor $s_1$ is reduced so that the curve path $s_2$ results, while the stability factor $s_3$ of the stabilizer increases with a decreasing Mach number, for reasons which need not be explained herein. The effects of both stability factors together yield a course of a curve $s_4>1$, as long as the training flight Mach number is $Ma>Ma_3$. If the value falls below $Ma_3$, the training missile becomes unstable, leading to a correspondingly strong increase in aerodynamic resistance and to the desired, short residual flight range.

Figure 2A:
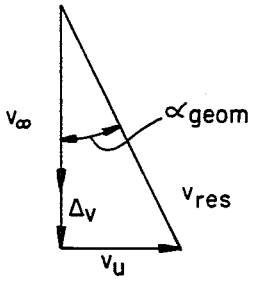
Figure 2B:
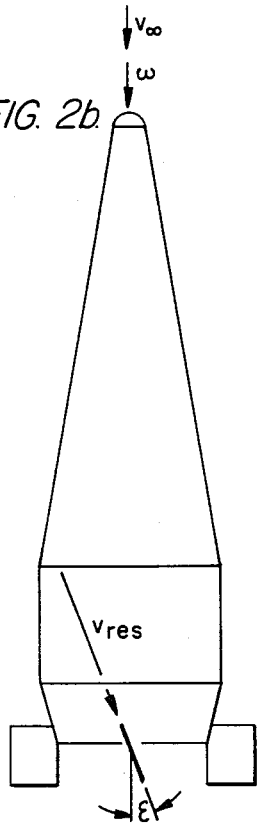
Figure 2C:
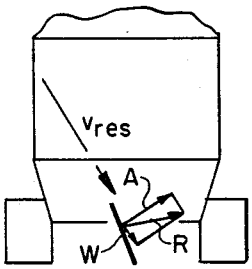
Figure 2D:
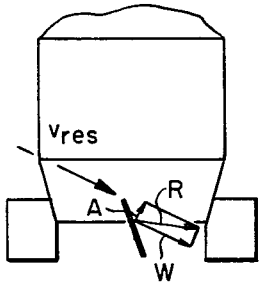

FIGS. 2*b–d* show qualitatively the size and the angle of incidence $\alpha_{geom}$ of the resultant velocity $v_{res}$ in various flight conditions. The geometric angle of incidence $\alpha_{geom}$ is the angle formed by the resultant velocity $v_{res}$ with the longitudinal axis of the training missile. The resultant flight velocity $v_{res}$ is, in turn, the sum from the velocity of the undisturbed oncoming flow $v_\infty$, the change in velocity $\Delta v$ at the surface of the missile due to the thickness distribution of the missile, and the peripheral speed on account of the rotation of the missile $v_u=\omega.r$. The velocities are to be considered as vectors in this connection. This relationship is shown in FIG. 2*a*.

At the beginning of the training flight path, as shown in FIG. 2*b*, the correspondingly predetermined adjustment angle $\epsilon$ of the stabilizer surfaces and the geometric angle of incidence $\alpha_{geom}$ are preferably more or less identical so that there is no influence, or only a slight influence, exerted by the stabilizer on the angular velocity $\omega$. The stabilizer reacts only to the angle of incidence $\alpha$ of the oncoming flow $v_\infty$, i.e. it ensures stability as desired. The angle of incidence $\alpha$ here is equal to zero because of the axial oncoming flow $v_\infty$.

According to a certain flying time t, after which the flight velocity $v_\infty$ has normally decreased more rapidly due to aerodynamic forces, $\alpha_{geom}$ has become larger than $\epsilon$ according to FIG. 2*c*, and the resultant aerodynamic force R at the stabilizer brakes the rotation to an increasing extent.

The stabilizer-produced longitudinal moment M=n.r.R, braking the rotation of the training missile, rises continuously during the training flight time with the effective incidence angle $\alpha_{eff}=\alpha_{geom}-\epsilon$. In the connection, n designates the number of stabilizer surfaces and r designates the average distance of these surfaces from the longitudinal axis.

Toward the end of the training flight time, $\alpha_{eff}=\alpha_{geom}-\epsilon$ can have become so large, according to FIG. 2*d*, that the flow generating the lift A has more or less broken down, and the resistance W predominates. This, however, is not deleterious because the resultant aerodynamic force R continues to reduce the angular velocity $\omega$ until the missile becomes unstable.

The longitudinal moment M of the stabilizer is affected, besides by n and r, also by the size and shape of the stabilizer surfaces, because of $R=\sqrt{A^2+W^2}$. Thus, there are sufficient parameters available to adapt the stabilizer to the respective requirements of a training missile.

The four versions of the invention, as shown, differ by the degree of true simulation of the original trajectory and the technical expenditure necessary for this purpose.

Figure 3A:
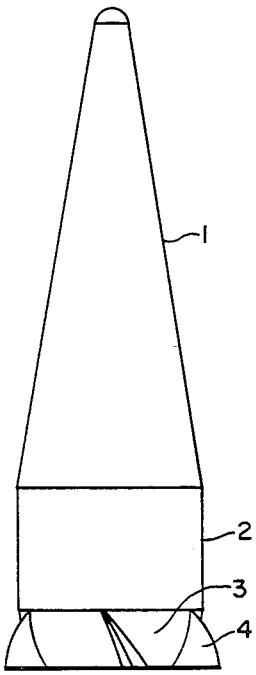
Figure 3B:
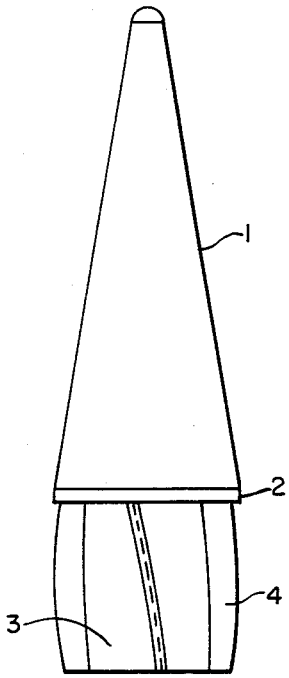

The embodiments shown in FIGS. 3*a* and 3*b* are distinguished by the fact that they do not exhibit any components movable with respect to one another and thus can be manufactured in a simple way. The subcaliber drill projectile shown in a lateral view in FIG. 3*a* comprises the ogive 1, the cylindrical portion 2 and the tail 3 with a fixedly mounted stabilizer 4. As compared with the conventional drill projectiles, this projectile has the advantage that its aerodynamic configuration coincides extensively with that of the original missile. The deviations at the tail 3 have only minor effects in a supersonic flow. The embodiment in FIG. 3*a* differs from the original ammunition during flight only by the fact that the chronological spin curves $D(t)=I_1.\omega(t)$ do not coincide. However, due to the additional airfoil stabilization, this is not so important as in the conventional training missiles. The adjustment angle $\epsilon$ of the stabilizer surfaces is chosen so that a marked spin reduction occurs only after traversing the training flight path, which, of course, prolongs the maximum flight path as compared with the case wherein the spin is reduced from the beginning. In particular, the adjustment angle $\epsilon$ is selected to be equal to the average (mean) geometric angle of incidence $\alpha_{geom}$ on the training flight path, so that the stabilizer initially exerts a longitudinal moment on the training missile, accelerating the rotation of the latter, and only thereafter exerts a braking longitudinal moment.

The shape of the individual surfaces of the stabilizer 4 in outline is not limited to a triangle or rectangle, in the embodiment in FIG. 3*a* and also in the other embodiments of the invention. Also any other airfoil contours are usable in principle. The stabilizer surfaces can be planar or twisted and/or curved. They can also be replaced, depending on the circumstances of a specific case, by mere aerodynamic resistance elements, for example cylindrical extensions radially arranged in uniform distribution over the periphery, these extensions increasing aerodynamic stability and simultaneously braking the rotation of the training missile.

The stabilizer 4 in the embodiment of FIG. 3*a* is supercaliber and thus usable only for a subcaliber missile. In contrast, the other embodiment shown in FIG. 3*b* is also suitable for a fullcaliber ammunition. The drill projectile is likewise shown in a lateral view; in this figure, as well as in the other figures, identical parts are in each case denoted by the same reference numerals. On account of the disturbed flow in the region of the stabilizer 4 and due to the less advantageous form of the stabilizer surfaces of the embodiment in FIG. 3*b*, the entire stabilizer area, with the same effectiveness, must be larger than in the embodiment of FIG. 3*a*; this may be deleterious due to excessive deviation from the original contour. In this case, one of these two versions can be of advantage.

The version of the missile shown in the two embodiments of FIGS. 3*a* and 3*b* is fail-safe, as can be seen from FIG. 1. The stabilizing effect of the stabilizer is necessary during the entire training flight period $t(Ma_1) \leqq t \leqq t(Ma_3)$. To maintain stability even for $t > r(Ma_3)$, the stabilizer would have to be enlarged. Destruction of the stabilizer, for example by ricocheting, is thus fail-safe.

Figure 4A:
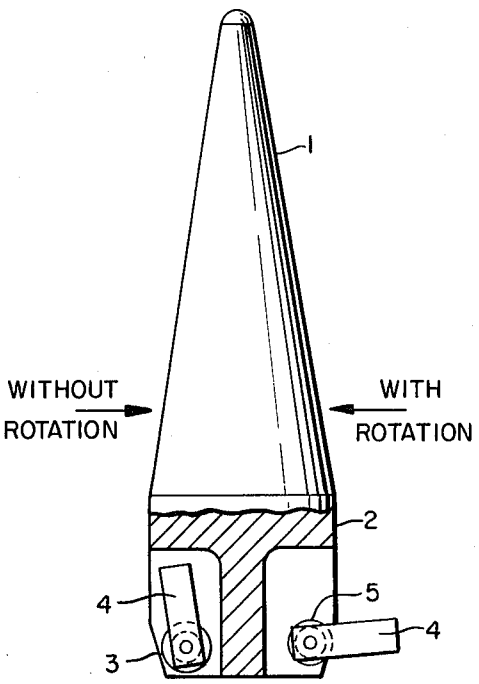
Figure 4B:
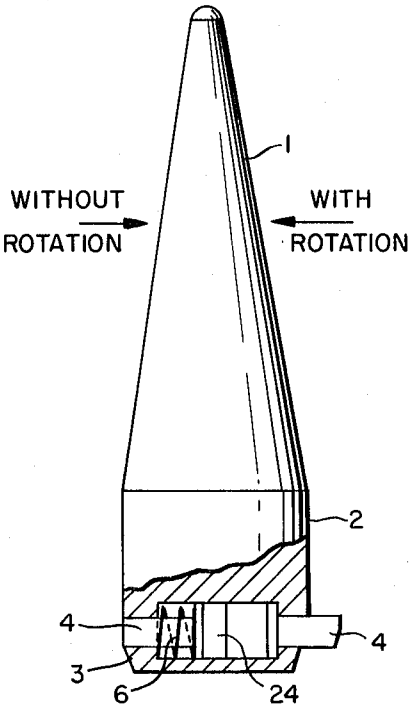
Figure 4C:
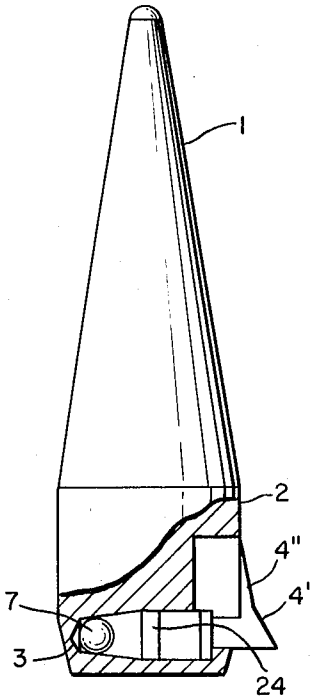

FIGS. 4*a–c* show three different embodiments of another version of the training missile, again in a lateral view and in a sectional view in the tail area. The embodiments of FIGS. 4*a* and 4*b* show, in the left-hand half, the condition without rotation and, in the right-hand half, the condition with rotation, i.e. after firing has taken place. In contrast, FIG. 4*c* shows only the condition with rotation.

This version is equipped with conventional folding or extensible stabilizers. It has the advantage that interface problems with the firing device, the propellant charge, the propellant charge case, or the sabot need not be expected with a training projectile. In an individual case, the increased manufacturing costs and possible problems regarding the strength may be disadvantageous under certain circumstances.

In case of the embodiment in FIG. 4*a*, a stabilizer is provided having at least two surfaces 4; these surfaces are retained by, respectively, one torsion spring 5 initially within the outer contour of the cylindrical part 2 and of the tail 3. With rotation, the stabilizer surfaces 4 are unfolded by centrifugal force.

A corresponding description applies to FIG. 4*b*. In this case, the surfaces 4 of the stabilizer device are loosely inserted in the tail 3 in the radial direction. Toward the inside, the displacement path of these surfaces is restricted by the stop 24. The elements providing the surfaces are pulled outwards by centrifugal force and arrested. Additionally, the stabilizer surfaces 4 can be—as indicated in dashed lines—under a radially inwardly directed bias of a spring or some other power element 6 to reduce the effectiveness of centrifugal force. Thereby, the stabilizer surfaces 4 exposed to the air flow can be reduced in their effect during the training flight period, in correspondence with any possibly posed requirements. The surfaces 4 can also be twisted. In FIG. 4*b*—spring-stressed and twisted surfaces 4—it is then possible to adapt also the average adjustment angle $\epsilon$ to the changed oncoming flow conditions.

Insofar as the aerodynamic asymmetries connected therewith can be neglected or can be tolerated in an individual case, a stabilizer with only one surface 4 can be provided according to the embodiment of FIG. 4*c*; in this case, the surface has the shape of a delta wing 4' with an airfoil 4''. To avoid dynamic unbalance, a ball 7 acting as a counterweight is moved radially to the outside in synchronism with the stabilizer surface 4.

The embodiments in FIGS. 5*a* through 5*e* are shown again in a lateral view and partially in section. These embodiments are distinguished by the fact that the stabilizer surfaces 4 are formed on a separate stabilizer carrier 8 which is rotatable with respect to the remaining training missile in the axial direction, i.e. about its longitudinal axis. This remaining training missile is here formed by the ogive 1, the cylindrical part 2 and optionally the tail 3 and will be called base member 9 hereinbelow for the sake of simplicity. The stabilizer surfaces 4 can be fashioned integrally with the stabilizer carrier 8 or can also be manufactured separately and joined to the carrier in a suitable way.

Figure 5D:
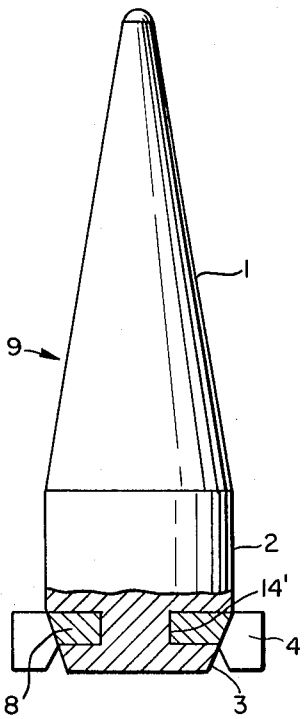
Figure 5C:
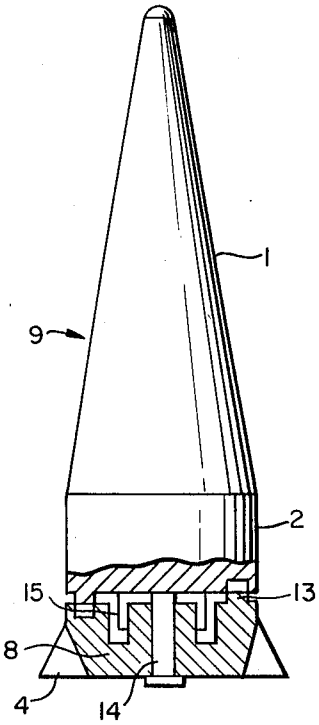
Figure 5B:
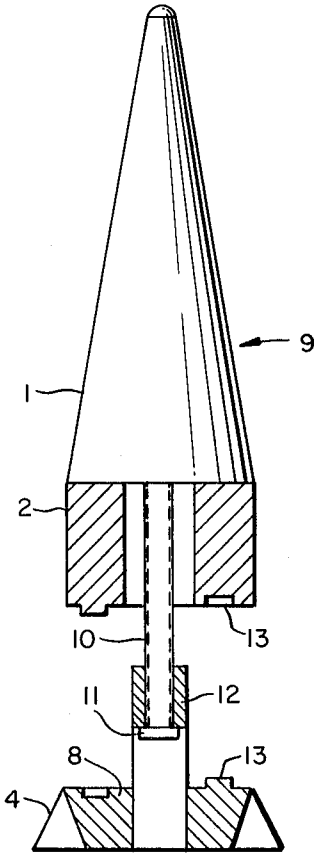
Figure 5A:
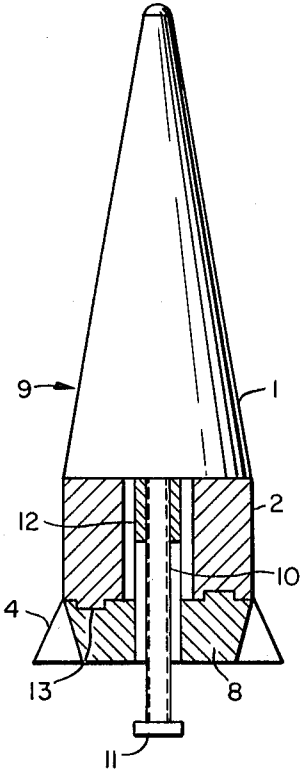

In the embodiment of FIGS. 5*a* and 5*b*, the rotatability of the stabilizer carrier 8 is ensured by the helical spindle 10 with rear stop 11 connected to the base member 9. On this spindle, the stabilizer carrier 8 is axially displaceable to a limited extent with the aid of its guide 12 between the forward position shown in FIG. 5*a*—the position up to firing (launch)—and the rearward position shown in FIG. 5*b*, with a corresponding rotation.

The functional operation after leaving the firing device takes place in three phases.

First phase:

The adjustment angle $\epsilon$ of the stabilizer surfaces 4 is determined so that initially the geometric angle of incidence (attack) $\alpha_{geom}$ is smaller than $\epsilon$. Thus a longitudinal moment is produced at the stabilizer carrier 8 in the direction of rotation of the training missile. As a consequence, the stabilizer carrier 8, with a corresponding orientation of the helical thread, travels rearwardly on the spindle 10. The displacement and rotary distance is determined so that the stabilizer carrier 8 abuts the stop 11 and thus assumes its rearward position shown in FIG. 5*b* at the time $\alpha_{geom}$ has become equal to $\epsilon$.

Second phase:

The geometric angle of incidence $\alpha_{geom}$ becomes larger than the adjustment angle $\epsilon$. Thereby, a longitudinal moment is produced in opposition to the direction of rotation of the training missile, on the basis of which the stabilizer carrier 8 travels on the spindle 10 again toward the front until the configuration is achieved as shown in FIG. 5*a*. The stabilizer carrier 8 and the helical spindle 10 are furthermore preferably designed so that the end of the second phase coincides with the end of the training flight period. This accomplishes in an advantageous fashion that, during the training flight time, practically no moments are transmitted to the base member 9 and thus its angular velocity $\omega$ is not affected, if the friction of spindle 10 is negligible because it is compensated for on the average by the to and fro threading rotation.

Third phase:

The stabilizer carrier 8 now brakes the rotation of the base member 9, namely to an increasingly stronger extent, because the geometric angle of incidence $\alpha_{geom}$ becomes ever larger, until the entire training missile becomes unstable.

To transmit, during travel within the firing device, the torque for spin stabilization from the stabilizer carrier 8 to the base member 9, the serration 13 is provided between the two, lying in a cross-sectional plane.

The training missile according to the embodiment of FIGS. 5*a* and 5*b* is safe:

(a) If the spindle 10 breaks off, or the stabilizer carrier 8 is detached in some other way, the training missile becomes prematurely unstable.

(b) If the spindle 10 and the guide means 12 jam at any time during the training flight period, the spin of the training missile is prematurely reduced, leading to a further reduction in the maximum flight path.

The training missile according to this embodiment has a particularly good coincidence with the original missile from the viewpoint of aeroballistics:

if the masses of both missiles are the same or, with a similar external shape of both missiles, are ballistically adapted, i.e. the ratio of means to aerodynamic reference area is the same in both missiles (the aerodynamic reference area is normally the cross-sectional area);

if the reduced spin stability s(spin) is compensated for in an approximation by the increased lever arm of the stabilizer on account of the rearwardly migrating stabilizer carrier 8 ($I_q$ rises);

if, as indicated above, the friction forces of the spindle 10 are compensated on the average.

The advantage of this embodiment of FIGS. 5*a* and 5*b* over the embodiments shown in FIGS. 3*a* and 3*b* and FIGS. 4*a*–4*c* resides in that the chronological curve of the angular velocity of the training missile during the training flight period coincides well with the chronological curve of the angular velocity of the original missile, so that there is satisfactory coincidence in the firing accuracy.

In the embodiment shown in FIG. 5*c*, the difference as compared with the embodiment of FIGS. 5*a* and 5*b* wherein, after termination of the second phase, a rigid, non-slip coupling exists between the stabilizer carrier 8 and the base member 9 resides in that the stabilizer carrier 8 with the stabilizer surfaces 4 is arranged to be freely rotatable on the pin-shaped bearing 14 after the stabilizer carrier 8 has been shifted slightly toward the rear after firing has taken place, so that the serration 13 does not mesh. The spin reduction in the base member 9 by moment transmission from the stabilizer carrier to the base member can be executed, for example, in the manner of a frictional coupling by means of at least one pretensioned compression spring arranged between the two elements and effective in the longitudinal direction. However, preferably a contact-free longitudinal moment transmission is provided. The coupling 15 intended for this purpose, as shown schematically in the figure, can operate conventionally in the manner of an electrical eddycurrent brake or a short-circuited generator. In correspondence with the respective aeroballistic requirements, the angular velocity of the stabilizer carrier can be freely selected by choosing a corresponding adjustment angle $\epsilon$ for the stabilizer surfaces 4. This angular velocity must only be different from the angular velocity of the base member 9, in view of the relative rotary motion required between the two elements for the intended braking effect. Thus, here again the adjustment angle can be equal to the mean geometric angle of incidence $\alpha_{geom}$ on the training flight path to still further reduce the aeroballistic deviations from the original missile.

Insofar as an even greater simulation fidelity is desired, it is advantageously possible, with the aid of an electronic circuit which is fail-safe, to overcome, for example, the short circuit of the coupling 15 designed as a generator during the training flight period. The required functional safety of the electronic circuit can be achieved, for example, by a redundant design, or by automatically reestablishing the short circuit upon the occurrence of any error in the circuit. By the selection of an appropriate setting angle $\epsilon$ of the stabilizer surfaces 4, it is then furthermore possible to provide that, on the average, the angular velocity of the stabilizer carrier 8 during the uncoupled condition is equal to that of the base member 9. Thus, due to the approximately equal chronological curves of the angular velocities of the base member 9 and the original missile, the aeroballistic deviations from the latter are even further reduced.

The embodiment shown in FIG. 5*d* is a modification of that shown in FIG. 5*c* wherein the stabilizer carrier 8 is fashioned as a ring freely supported, i.e. with unlimited rotatability, in the bearing 14' of the base member 9 with a minor axial and radial play, not shown. In this integrated arrangement of the stabilizer carrier 8 within the structure of the training missile, the serration 13 can be omitted since during firing the spin transmission can take place directly via the tail 3 to the training missile. Here again, electronic circuits can also be preferably provided, establishing a force-derived connection between the stabilizer carrier, which freely rotates with respect to the base member, and the base member only at the end of the training flight phase. The description set out above applies for the construction and arrangement of the stabilizer surfaces 4 at the ring 8.

In the embodiments of FIGS. 5*a*, 5*b*, 5*c* and 5*d* described above, the longitudinal moment of inertia $I_1$ of the stabilizer carrier is very much smaller than that of the base member. This is no longer the case in the embodiment illustrated in FIG. 5*e*. The stabilizer carrier 8 here extends forwardly, for example over half the length of the training missile, and the base member 9 extends over the stabilizer carrier with a relatively thin-walled sleeve- or hood-shaped or similar part 16. The stabilizer carrier 8 is freely rotatably disposed on the bearing 14 in correspondence with the embodiment of FIG. 5*c*. For this purpose, the carrier is arranged in the recess 17 of the base member 9 with a correspondingly small play in the radial and axial directions. The stabilizer carrier 8 thus is located practically within the base member 9 except for the stabilizer surfaces 4, so that advantageously the predominant portion of the stabilizer carrier does not affect the flow relationships as compared with the original missile.

The external contour of the base member 9 preferably corresponds extensively to that of the original missile to keep the aeroballistic deviations at a minimum. The relatively small trim tab or auxiliary stabilizer 18 arranged at the rear end of part 16 serves for compensating for the drop in angular velocity during the training flight phase caused by the fact that the base member 9 per se has a lower longitudinal moment of inertia than the original missile; this compensation is effected by correspondingly accelerating the rotation of the base member 9 by means of the stabilizer 17. The training missile as a whole is designed so that the longitudinal moments of inertia of the base member and the stabilizer carrier together are equal to the longitudinal moment of inertia of the original missile, and that the stabilizer carrier alone is braked with respect to the base member so that the stabilization s(stabilizer carrier)+s(spin of base member) at the earliest at the end of the training flight path is no longer sufficient to stabilize the training missile.

FIG. 6*a*, finally, shows a fourth version offering the possibility of coordinating the aeroballistic properties of the original missile and the training missile in an especially advantageous fashion. For this purpose, a training missile according to the first version (FIG. 3*a* or 3*b*) is equipped with a propulsion unit with nozzles 19, gas conduit 20, and a solid propellant charge 21. The nozzles 19 are arranged symmetrically in the traning missile, as also illustrated in FIG. 6*b* as a sectional view along line A—A in FIG. 6*a*. The nozzles are oriented in an inclined fashion so that they produce a torque about the longitudinal axis of the missile as well as thrust. The torque during the trailing flight period serves for compensating for the braking moment of the stabilizer surfaces 4, while the thrust compensates for the increased aerodynamic resistance due to the stabilizer surfaces 4 as well as due to the reduction in mass on account of combustion of the propellant. The propulsion unit is simultaneously a tracer flare and is activated via the ignition duct 22 by the powder gases during firing. The necessary thrust/moment curve in dependence on the time can be obtained by an appropriate outer contour 23 of the propellant charge 21.

The propellant grain is designed and fixed in its shape, if at all possible, so that the quotient $I_1^2/I_q$ changes as little as possible during the training flight period. After traversing the training flight distance, the propulsion unit is burnt out, as intended, so that the spin reduction on account of the stabilizer becomes effective.

The application of the idea of this invention—combined spin-tail unit stabilization, with an increased spin reduction by the tail unit—can lead to varying designs for the training missile in correspondence with the above explanations. All designs have the feature in common that the problem of fail-safe functioning can be solved by simple means.

On account of the extensive coincidence of the external shape, the training missile according to the versions denoted by numeral 1 can normally be manufactured with the use of the same devices as for the original missile. This also applies, in principle, with regard to the second version. The embodiment of FIG. 4*c* has the advantage that the tail flow is little interfered with. A fixed installation of stabilizer surface and counterweight would here result in an embodiment of the type shown in FIGS. 1*a* and 1*b* with comparatively low manufacturing costs.

Figure 5E:
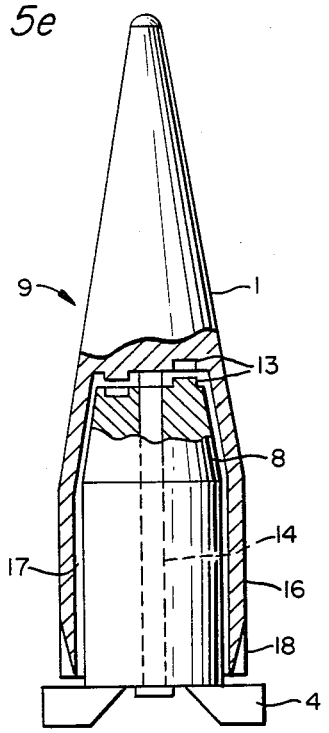

The embodiments with an electronic circuit, e.g. FIGS. 5*a*, 5*b*, 5*c* and 5*d* have the advantage that, due to the special coupling between the stabilizer carrier and the base member, the spin reduction, increased as compared with the original missile, becomes effective only after the training flight path has been traversed. This third version of the device moreover leaves freedom, as compared with the first and second versions regarding parameters such as, for example, the angular velocity of the stabilizer carrier, by means of which the simulation of the trajectory of the original missile by the training missile can be still further improved. The embodiment of FIG. 5*e* is generally suitable only for large-caliber ammunition and simulates the original trajector very accurately.

The shifting of the center of gravity as compared with the original missile, required for the training missile, can be obtained by selecting a suitable material. The first version, for example, then differs externally merely by a new tail with integrally formed stabilizer surfaces or by the fact that stabilizer surfaces are attached by screws.

Corrections of the starting mass, the position of the center of gravity, or the moments of inertia can also be attained by suitable bores which, as desired, are left vacant or are filled, for example, with lead. Corresponding description applies with regard to the other versions.

We claim:

1. A spin-stabilized training missile which comprises a base member shaped as a missile with a stabilizer means for reducing spin in order to decrease the flight range, the base member of the training missile, upon firing, having a stability due to spin that is too low for stable flight, and said stabilizer means comprises at least one element having a stabilizer surface which effects, on the one hand, an additional aerodynamic stabilization providing stable flight in the training range together with the spin stabilization of te base member and, on the other hand, after leaving the training range, such a spin reduction that the training missile becomes unstable; the stabilization attainable by spin upon firing of the training missile base member, without the stabilizer means, is defined by a stability factor $s<1$, said stabilizer means, which is mounted behind the center of gravity of said base member, initially compensating for the lack of stability of the base member and then generating a longitudinal moment which brakes the rotation of said training missile.

2. A training missile according to claim 1, wherein the stabilizer surface is provided by an unfolding or extensible stabilizer element.

3. A training missile according to claim 2, wherein a power element is associated with the stabilizer surface, said power element exerting on the stabilizer surface a radially inwardly directed force in such a way that the surface, with a reduction in the centrifugal force of the rotating training missile, is at least partially retracted again.

4. A training missile according to claim 1, wherein the stabilizer is formed at a separate stabilizer means carrier, which is connected to the remaining training missile, forming a base member and is rotatable relatively to this base member.

5. A training missile according to claim 4, wherein the base member is provided with a rearwardly oriented, axial helical spindle on which the stabilizer carrier is disposed to be rotatable and displaceable between a forward and a rearward position; and that the spin reduction is effected by mechanical coupling between the stabilizer carrier and the base member.

6. A training missile according to claim 4, wherein for spin reduction, a moment transmission is provided from the stabilizer carrier to the base member during which the stabilizer carrier rotates relatively to the base member.

7. A training missile according to claim 4, wherein the stabilizer carrier is freely rotatable during the spin reduction with respect to the base member, and exhibits a longitudinal moment of inertia of such a size that its braking alone provides the desired spin reduction.

8. A training missile according to claim 7, wherein the stabilizer carrier is extended toward the front and, with this extension, projects into a corresponding axial recess of the base member.

9. A training missile according to claim 7 or 8, wherein the base member, designed with a correspondingly reduced longitudinal moment of inertia, has an auxiliary stabilizer counteracting its spin reduction.

10. A training missile according to claim 1, wherein the center of gravity of the training missile base is displaced towards the rear of the base as compared with a combat missile of like configuration in order to reduce the spin stability of the training missile.

11. A training missile which comprises a base member shaped as a missile with a stabilizer means for reducing spin in order to decrease the flight range, the base member of the training missile, upon firing, having a stability due to spin that is too low for stable flight, and said stabilizer means comprises at least one element having a stabilizer surface which effects, on the one hand, an additional aerodynamic stabilization providing stable flight in the training range together with the spin stabilization of the base member and, on the other hand, after leaving the training range, such a spin reduction that the training missile becomes unstable; a jet propulsion unit being provided additionally to the stabilizer means, said propulstion unit exerting, during the training flight phase, a torque and a thrust for compensating for the braking effects of the stabilizer means.

12. A training missile according to claim 11, wherein the stabilizer surface is provided by an unfolding or extensible stabilizer element.

13. A training missile according to claim 12, wherein a power element is associated with the stabilizer surface, said power element exerting on the stabilizer surface a radially inward directive force in such a way that the surface, with the reduction in the centrifugal force of the rotating training missile, is at least partially retracted again.

14. A training missile comprises a base member shaped as a missile with a stabilizer means for reducing spin in order to decrease the flight range, the base member of the training missile, upon firing, having a stability due to spin that is too low for stable flight, and said stabilizer means comprises at least one element having a stabilizer surface which effects, on the one hand, an additional aerodynamic stabilization providing stable flight in the training range together with the spin stabilization of the base member and, on the other hand, after leaving the training range, such a spin reduction that the training missile becomes unstable, the adjustment angle of the stabilizer surface of the at least one element of the stabilizer means being selected to be equal to the geometric angle of incidence $\alpha_{geom}$ on the training flight path whereby the stabilizer means initially exerts a longitudinal moment on the training missile accelerating the rotation thereof and thereafter exerts a braking longitudinal moment on the training missile thereby reducing the rotation.

15. A training missile according to claim 14, wherein $\alpha_{geom}$, the geometric angle of incidence, is the angle formed by the resultant velocity $v_{res}$ of the training missile with the longitudinal axis of the training missile.

* * * * *